US009879938B1

(12) United States Patent
Isenhower et al.

(10) Patent No.: US 9,879,938 B1
(45) Date of Patent: Jan. 30, 2018

(54) REVERSE STYLE CROSSBOW HAVING FOUR CABLE PULLEYS

(71) Applicants: Rex E. Isenhower, Stanwood, IA (US); James J. Kempf, Coralville, IA (US)

(72) Inventors: Rex E. Isenhower, Stanwood, IA (US); James J. Kempf, Coralville, IA (US)

(73) Assignee: ARCHERY INNOVATORS, LLC

( * ) Notice: Subject to any disclaimer, the term of this patent is extended or adjusted under 35 U.S.C. 154(b) by 0 days.

(21) Appl. No.: 15/589,381

(22) Filed: May 8, 2017

Related U.S. Application Data

(60) Provisional application No. 62/343,880, filed on Jun. 1, 2016.

(51) Int. Cl.
*F41B 5/12* (2006.01)

(52) U.S. Cl.
CPC ..... *F41B 5/123* (2013.01)

(58) Field of Classification Search
CPC ..... F41B 5/0094; F41B 5/10; F41B 5/105; F41B 5/12; F41B 5/123
USPC ..... 124/23.1, 25, 25.6, 900
See application file for complete search history.

(56) References Cited

U.S. PATENT DOCUMENTS 3,841,295 A * 10/1974 Hunter ..... F41B 5/10 124/25.6
3,854,467 A * 12/1974 Hofmeister ..... F41B 5/10 124/25.6
3,958,551 A * 5/1976 Ketchum ..... F41B 5/10 124/25.6
4,054,118 A * 10/1977 McKee ..... F41B 5/10 124/25.6
4,061,124 A * 12/1977 Groner ..... F41B 5/10 124/25.6
4,077,385 A * 3/1978 Fredrickson ..... F41B 5/10 124/25.6
4,103,667 A * 8/1978 Shepley, Jr. ..... F41B 5/10 124/25.6
4,649,891 A * 3/1987 Bozek ..... F41B 5/123 124/25
4,722,317 A * 2/1988 Hartwig ..... F41B 5/10 124/25.6
4,917,071 A * 4/1990 Bozek ..... F41B 5/12 124/24.1
5,678,528 A * 10/1997 Hadley ..... F41B 5/12 124/24.1
6,470,870 B1 * 10/2002 Schaar ..... F41B 5/10 124/25.6
6,792,931 B1 * 9/2004 Schaar ..... F41B 5/10 124/25.6

(Continued)

*Primary Examiner* — Alexander Niconovich
(74) *Attorney, Agent, or Firm* — Donald J. Ersler

(57) ABSTRACT

A reverse style crossbow having four pulleys preferably includes a barrel, a riser, a first limb, a second limb, a first cam and a second cam. The riser is attached to the barrel. The first and second limbs extend from opposing ends of the riser. The first and second cams are rotatably retained on distal ends of the first and second limbs. First and second barrel pulleys are rotatably retained on opposing sides of the barrel. A first limb pulley is rotatably retained by the first limb and a second limb pulley is rotatably retained by the second limb. One end of a first cable is attached to the first cam and the other end is attached to the barrel. One end of a second cable is attached to the second cam and the other end is attached to the barrel. A single cable may also be used.

18 Claims, 8 Drawing Sheets

(56) References Cited

U.S. PATENT DOCUMENTS

| | | | | |
|---|---|---|---|---|
| 7,047,958 | B1 * | 5/2006 | Colley | F41B 5/10 124/25.6 |
| 7,578,289 | B2 * | 8/2009 | Norkus | F41B 5/0094 124/25 |
| 7,823,572 | B2 * | 11/2010 | Anderson | F41B 5/123 124/25 |
| 8,387,603 | B2 * | 3/2013 | Darlington | F41B 5/10 124/23.1 |
| 8,522,762 | B2 * | 9/2013 | Trpkovski | F41B 5/0094 124/23.1 |
| 8,578,918 | B1 * | 11/2013 | Islas | F41B 5/123 124/25 |
| 8,651,095 | B2 * | 2/2014 | Islas | F41B 5/105 124/25 |
| 9,234,719 | B1 * | 1/2016 | Kempf | F41B 5/105 |
| 9,243,861 | B1 * | 1/2016 | Kempf | F41B 5/12 |
| 9,297,604 | B1 * | 3/2016 | Sidebottom | F41B 5/123 |
| 9,377,267 | B1 * | 6/2016 | Kempf | F41B 5/105 |
| 9,513,080 | B1 * | 12/2016 | Kempf | F41B 5/123 |
| 9,829,268 | B1 * | 11/2017 | Kempf | F41B 5/123 |
| 2008/0251058 | A1 * | 10/2008 | Colley | F41B 5/105 124/25 |
| 2011/0056467 | A1 * | 3/2011 | Popov | F41B 5/0094 124/25.6 |
| 2012/0125302 | A1 * | 5/2012 | Stanziale | F41B 5/123 124/25 |

* cited by examiner

REVERSE STYLE CROSSBOW HAVING FOUR CABLE PULLEYS

CROSS-REFERENCES TO RELATED APPLICATIONS

This is a utility patent application taking priority from provisional application No. 62/343,880 filed on Jun. 1, 2016.

BACKGROUND OF THE INVENTION

1. Field of the Invention

The present invention relates generally to archery bows, and more specifically to a reverse style crossbow having four cable pulleys, which results in reduced limb travel.

2. Discussion of the Prior Art

It appears that the prior art does not teach or suggest a reverse style crossbow having four cable pulleys.

Accordingly, there is a clearly felt need in the art for a crossbow having four cable pulleys, which results in less limb travel, a faster spinning cam and an arrow being fired at a greater velocity than that of the prior art.

SUMMARY OF THE INVENTION

The cable configuration of the present invention has many benefits over prior art. In a prior art twin cam bow, the first limb flexes proportionally to the amount of cable that is wrapped upon the first cable cam, less the distance the second limb moves towards the first limb. In order to allow for less limb flex, binary style cams were developed, which allowed for cable "pay out," wherein the cable unwraps from a portion of the cams. This prior art required the complexity of payout to be integrated into the cam itself, and this restricted the amount of the cam's angular rotation, often to less than 200 degrees. U.S. Pat. No. 9,243,861 to Kempf et al. discloses allowing some amount of cable payout not associated to the cams, but still limited the amount of payout, and did not reduce the amount of limb flex. Another drawback to the pulley bow was that the cams were not synchronized with one another. The present invention allows for synchronization, self-timing, more cable payout, less limb flex, greater cam rotation, and greater efficiency. The present invention may use one string, which propels the arrow, and the use of at least one cable.

A bow limb (bow with "solid limbs"), or a set of limbs (bow with "split limbs"), typically has a proximal end, which is generally coupled to a frame (riser), and a distal end. The distal end is the usual location to couple the cams. Occasionally, the cams may be coupled to the limbs at a location between the proximal and distal ends. The cable and string configuration may be used on any design of bow, including but not limited to: vertical bows with the string coming off the rear of the cam; vertical bows having the string come off the front of the cam; crossbows with rear facing (standard) limb configuration where the string comes off the rear of the cam; crossbows with rear facing (standard) limb configuration where the string comes off the front of the cam; crossbows with forward facing (reverse draw style) limb configuration where the string comes off the front of the cam; crossbows with forward facing (reverse draw style) limb configuration where the string comes off the rear of the cam; crossbows where the cams are coupled to the limbs at a location between the distal and proximal portions of the limbs, and the string comes off the front side of the cams; crossbows where the cams are coupled to the limbs at a location between the distal and proximal portions of the limbs, and the string comes off the front side of the cams.

A crossbow frame of a crossbow having four cable pulleys preferably includes a riser, a barrel, limb pockets and a foot stirrup. The riser, barrel limb pockets and foot stirrup are preferably assembled using fasteners and the like. Additionally, the frame made be fabricated from a single piece of material by molding or formed as a single unit.

DETAILED DESCRIPTION OF THE PREFERRED EMBODIMENTS

Figure 1:
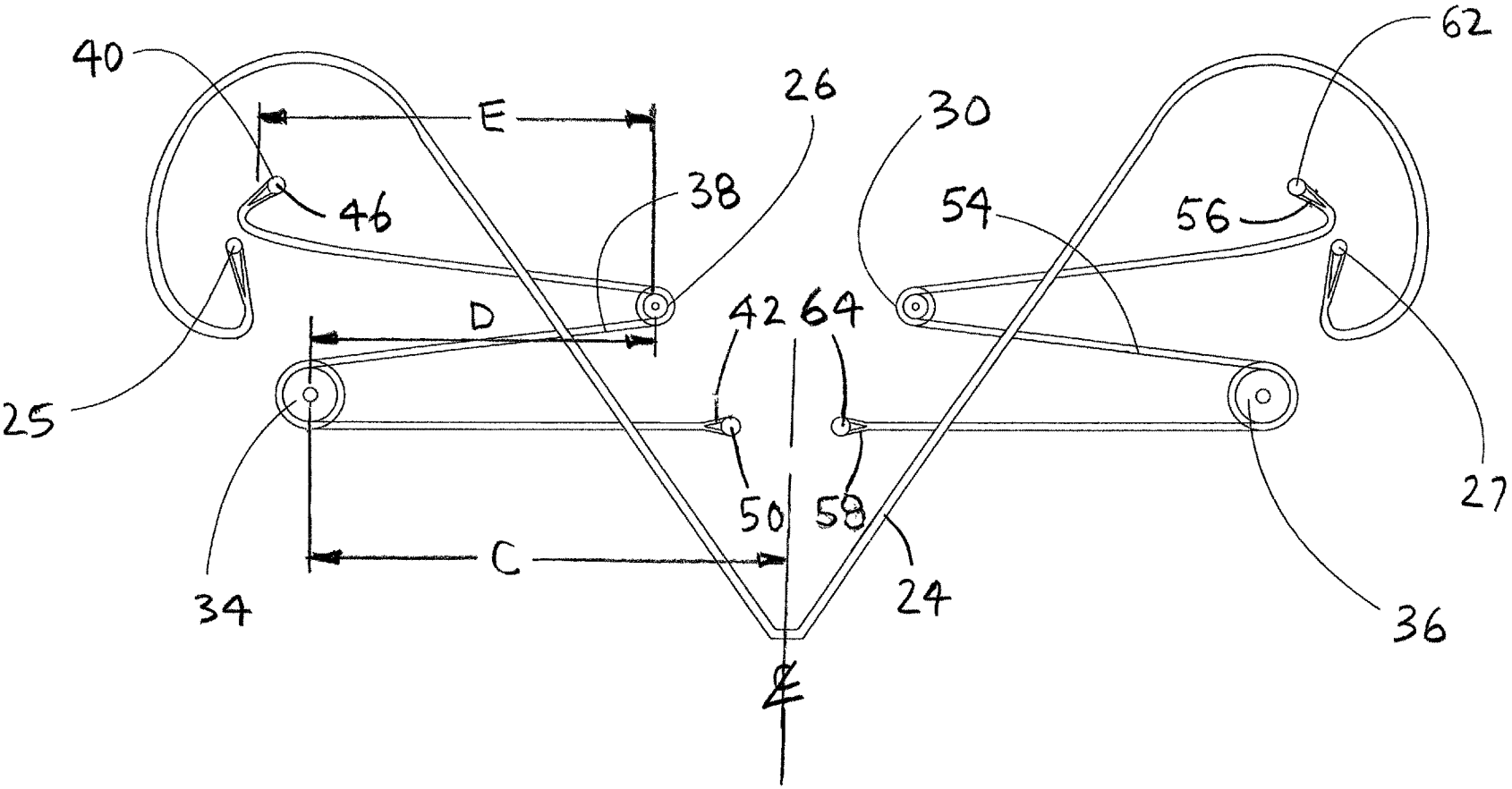
FIG. 1 is a top view of a bowstring and two cables laid out as if they were retained in a reverse style crossbow having four cable pulleys in accordance with the present invention.
Figure 3:
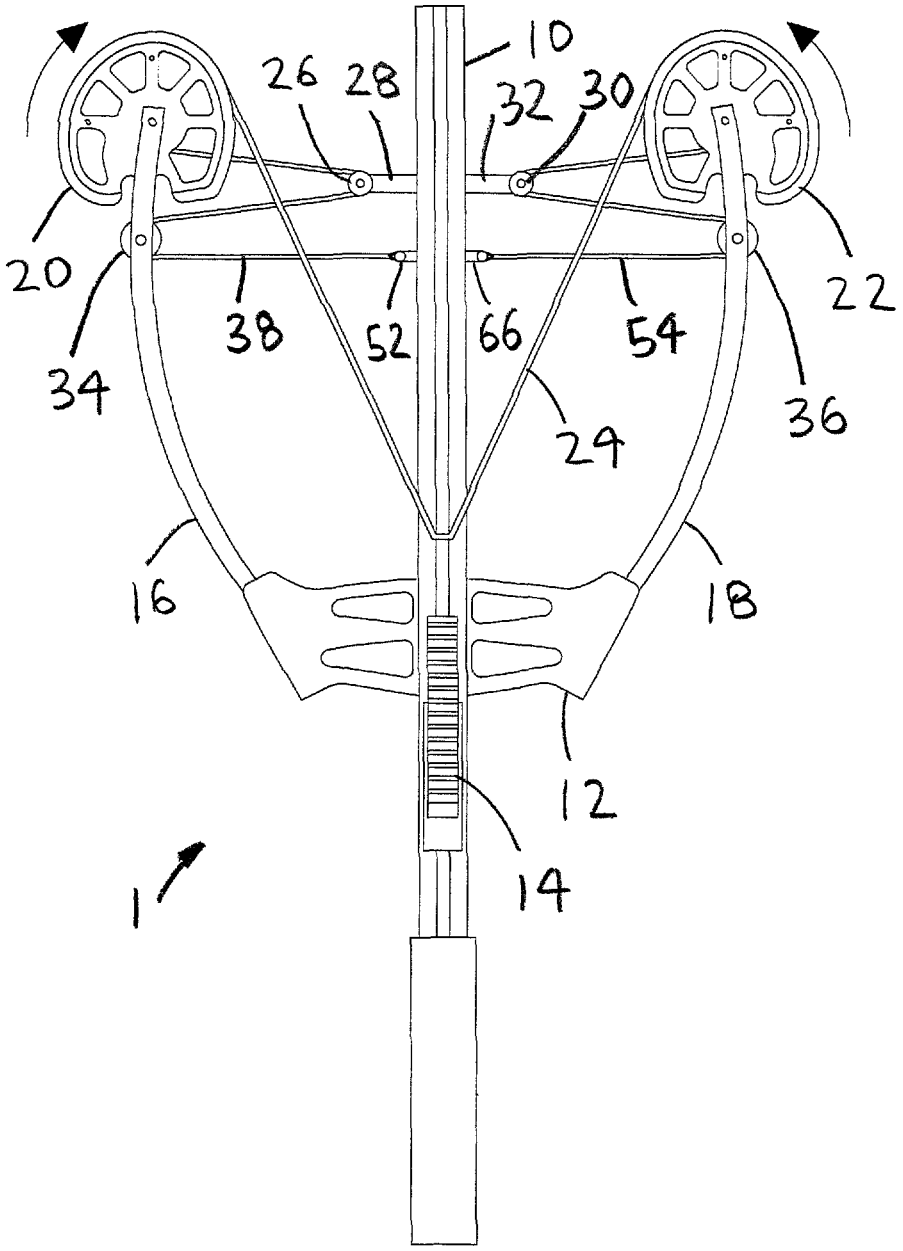
FIG. 3 is a top view of a reverse style crossbow having four pulleys, two cables and a bowstring in a partially drawn position, two of the four pulleys are rotatably retained in the first and second limbs in accordance with the present invention.
Figure 5:
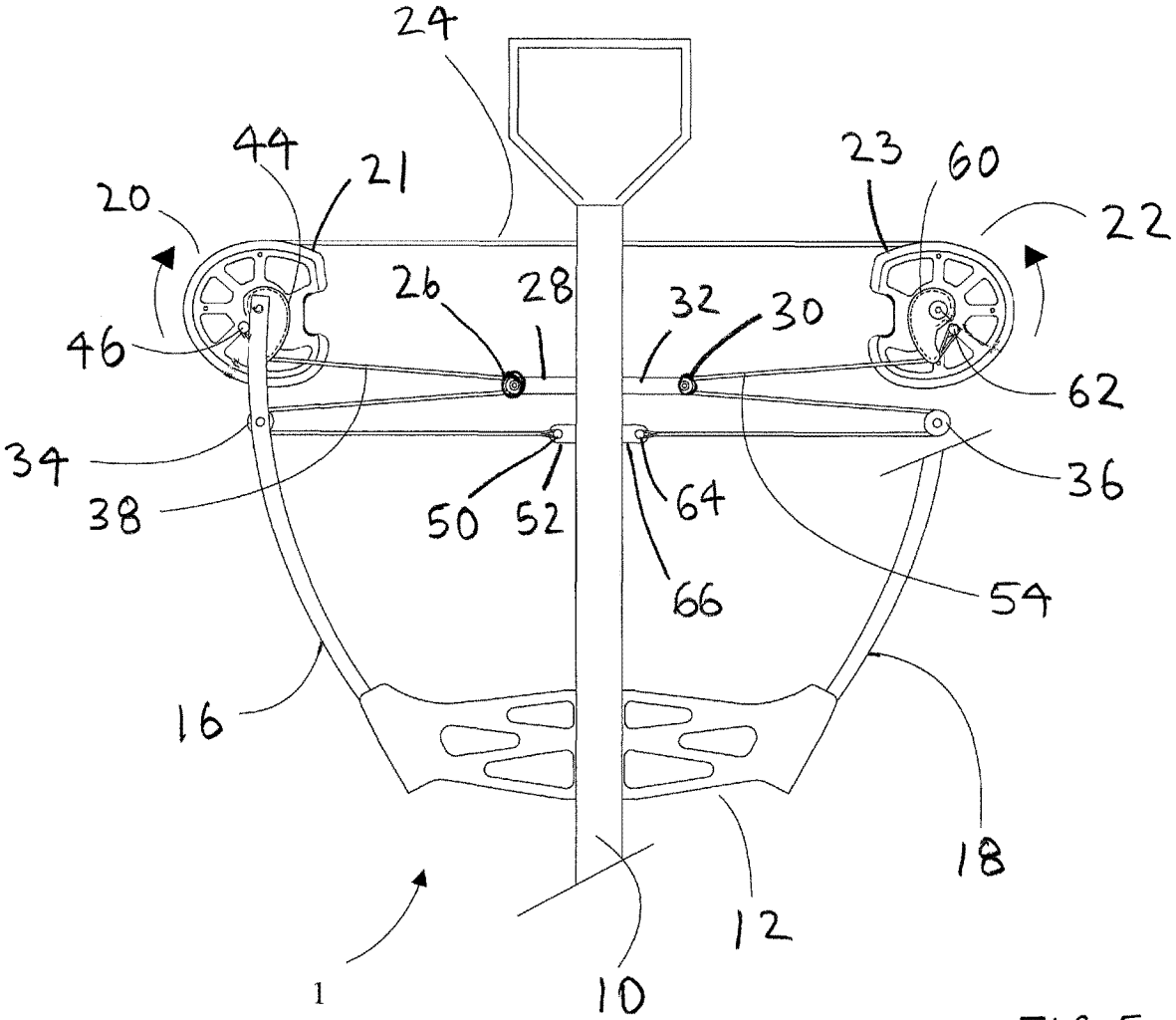
FIG. 5 is a bottom view of a reverse style crossbow having four pulleys, a bowstring and two cables, two of the pulleys are rotatably retained in the first and second limbs in accordance with the present invention.

With reference now to the drawings, and particularly to FIG. 3, there is shown a top view of a reverse style crossbow having four pulleys 1 with a bowstring 24 in a partially drawn position. The reverse style crossbow having four pulleys 1 preferably includes a barrel 10, a riser 12, a latch housing 14, a first limb 16, a second limb 18, a first cam 20 and a second cam 22. The riser 12 is attached to the barrel 10. The latch housing 14 is retained on the barrel 10, adjacent the riser 12. The first limb 16 extends from a first end of the riser 12 and the second limb 18 extends from a second end of the riser 12. The first cam 20 is rotatably retained on a distal end of the first limb 16 and the second cam 22 is rotatably retained on a distal end of the second limb 18. A first end 25 of the bowstring 24 is retained on the first cam 20 and a second end 27 of the bowstring 24 is retained on the second cam 22. The latch housing 14 is used to retain the bowstring 24 in a fully drawn position A first barrel pulley 26 is rotatably retained on a first side of the barrel 10, adjacent the first cam 20 with a first pulley bracket 28. A second barrel pulley 30 is rotatably retained on a second side of the barrel 10, adjacent the second cam 22 with a second pulley bracket 32. A first limb pulley 34 is rotatably retained in the first limb 16, adjacent the first cam 20. A second limb pulley 36 is rotatably retained in the second limb 18, adjacent the second cam 22. A first cable 38 includes a first end 40 and a second end 42. With reference to FIG. 5, the first cam 20 includes a first peripheral string track 21 and a first cable track 44 and a first cable post 46 located on a bottom thereof. Substantially, a first end of the bowstring 24 is retained in the first peripheral string track 21. With reference to FIG. 1, the first end 40 of the first cable 38 is retained on the first cable post 46 and the first cable 38 is retained in the first cable track 44. The second end 42 of the first cable 38 is retained on a first barrel cable post 50. The first barrel cable post 50 is attached to a first cable bracket 52. The first cable bracket 52 extends outward from a first side of the barrel 10.

A second cable 54 includes a first end 56 and a second end 58. The second cam 22 includes a second peripheral string track 23 and a second cable track 60 and a second cable post 62 located on a bottom thereof. Substantially, a second end of the bowstring 24 is retained in the second peripheral string track 23. The first end 56 of the second cable 54 is retained on the second cable post 62 and the second cable 54 is retained in the second cable track 60. The second end 58 of the second cable 54 is retained on a second barrel cable post 64. The second barrel cable post 64 is attached to a second cable bracket 66. The second cable bracket 66 extends outward from a second side of the barrel 10.

Figure 7:
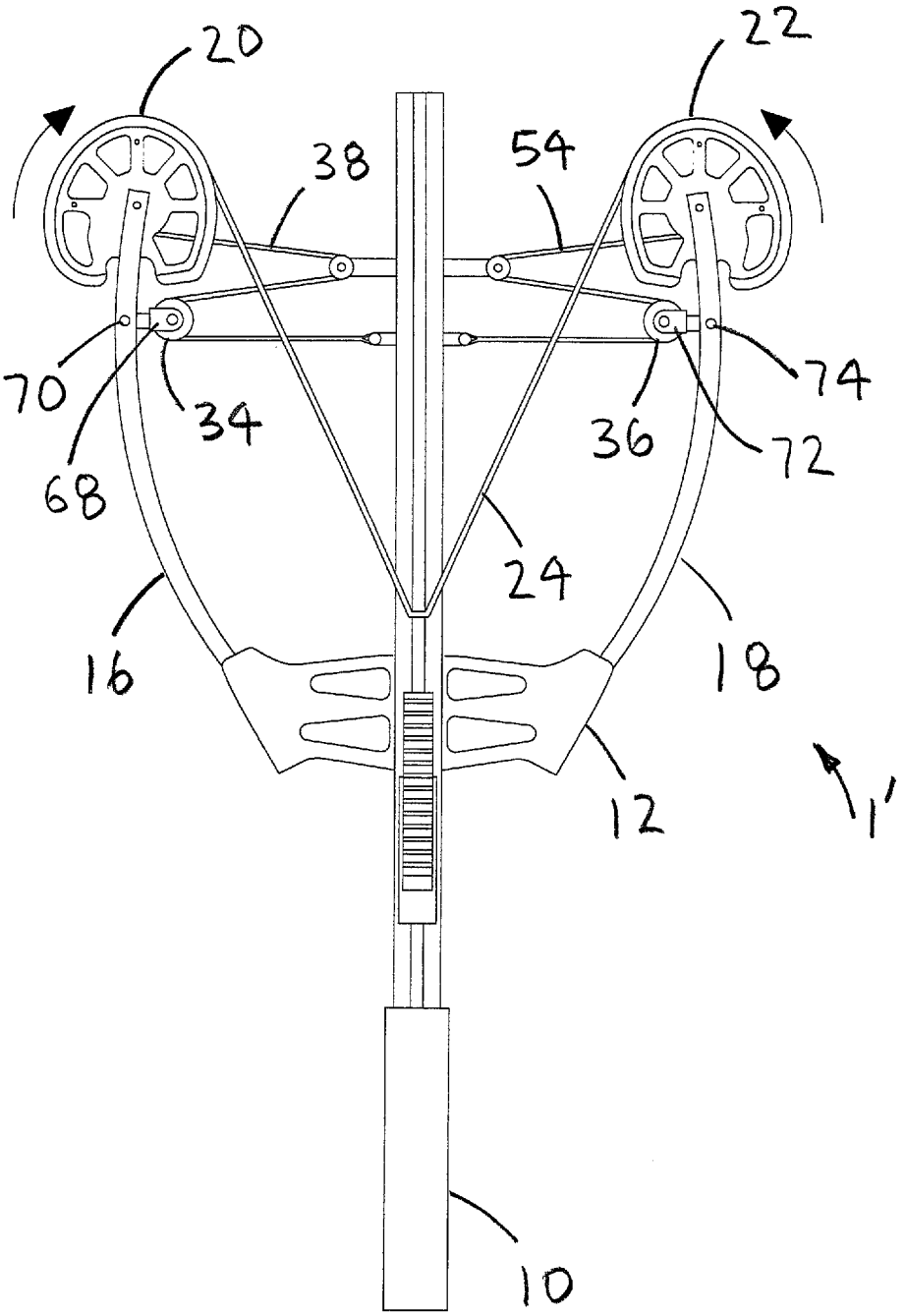
FIG. 7 is a top view of a reverse style crossbow having four pulleys, a bowstring and two cables in a partially drawn position, two of the pulleys are rotatably retained inward from the first and second limbs with first and second pulley yokes in accordance with the present invention.

With reference to FIG. 7, a reverse style crossbow having four pulleys 1' includes a first pulley yoke 68 and a second pulley yoke 72. One end of the first pulley yoke 68 is pivotally engaged with the first limb 16 utilizing a pin 70 or the like and the other end of the first pulley yoke 68 rotatably retains the first limb pulley 34. One end of the second pulley yoke 72 is pivotally engaged with the second limb 18 utilizing a pin 74 or the like and the other end of the second pulley yoke 72 rotatably retains the second limb pulley 36.

Figure 2:
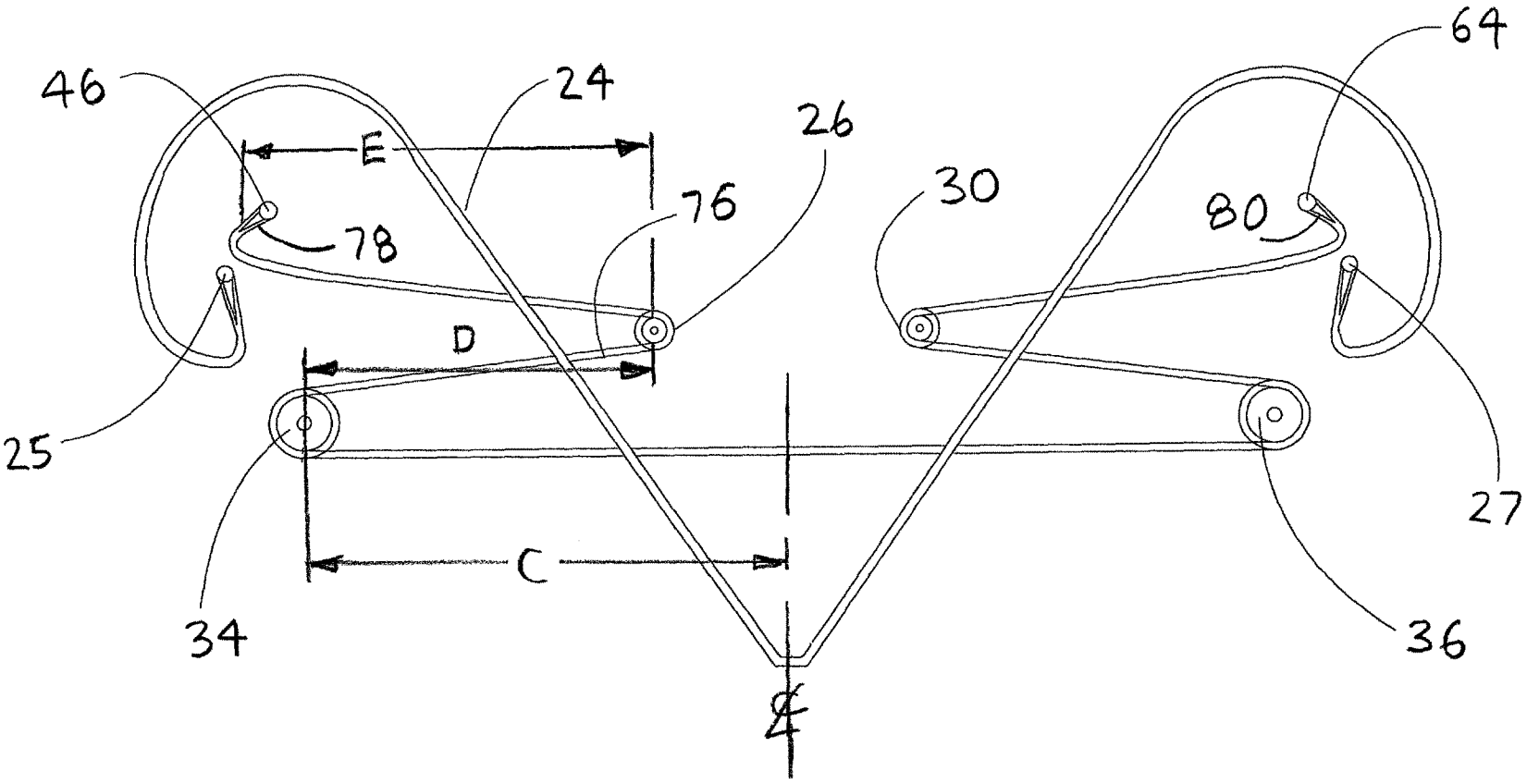
FIG. 2 is a top view of a bowstring and a single cable laid out as if they were retained in a reverse style crossbow having four cable pulleys in accordance with the present invention.
Figure 4:
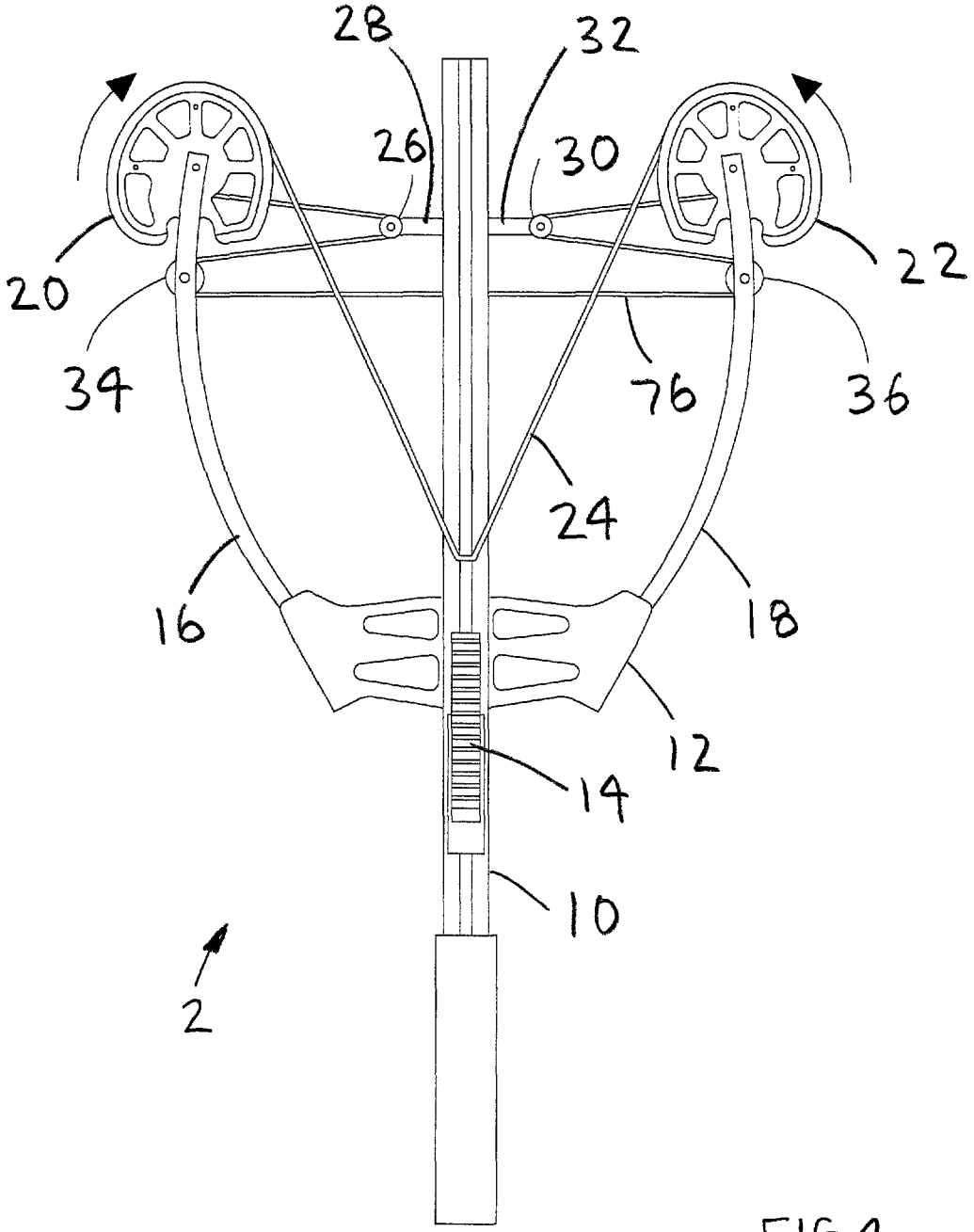
FIG. 4 is a top view of a reverse style crossbow having four pulleys, a single cable and a bowstring in a partially drawn position, two of the four pulleys are rotatably retained in the first and second limbs in accordance with the present invention.
Figure 6:
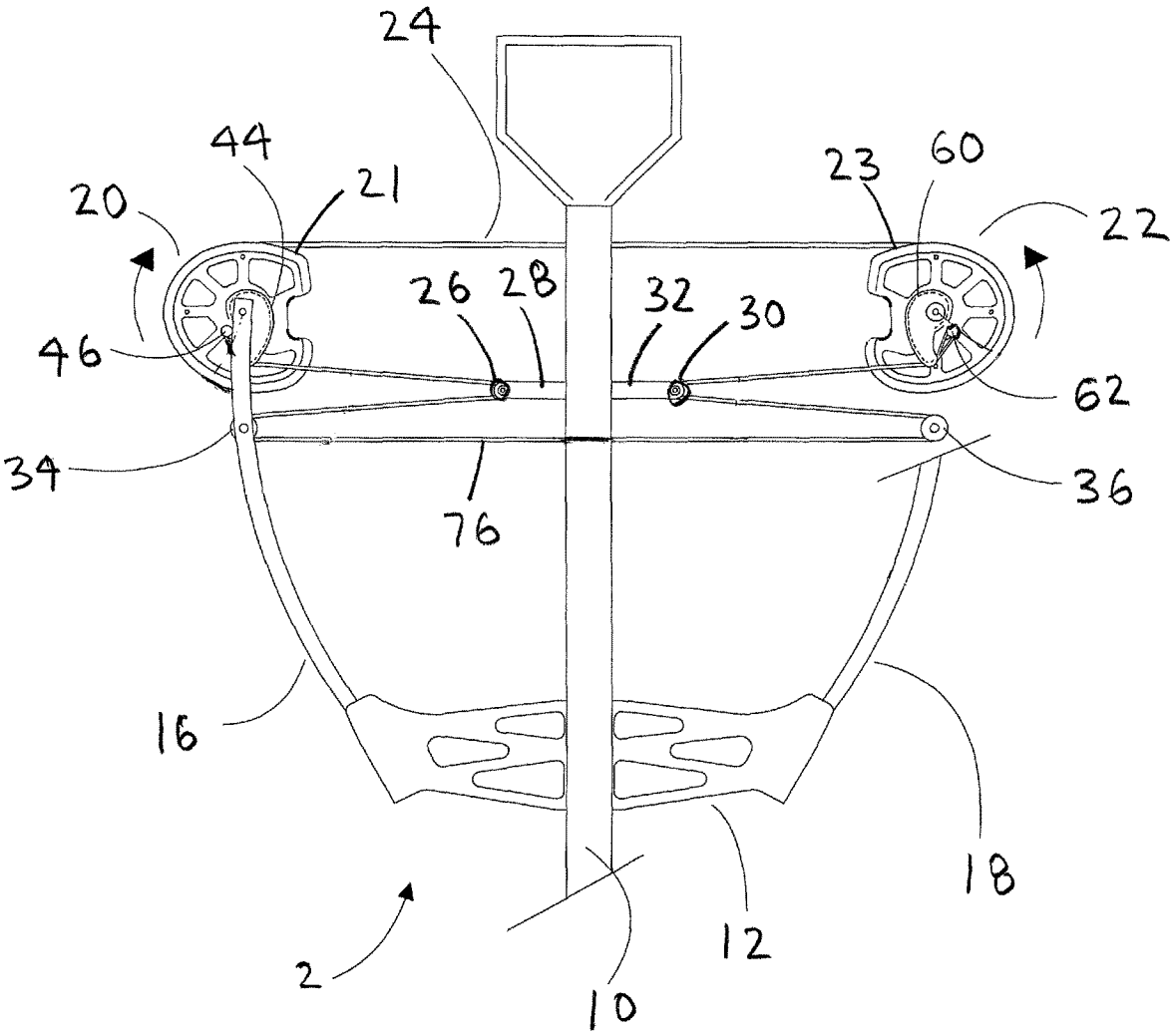
FIG. 6 is a bottom view of a reverse style crossbow having four pulleys, a bowstring and a single cable, two of the pulleys are pivotally retained in the first and second limbs in accordance with the present invention.

With reference to FIG. 4, the reverse style crossbow having four pulleys 2 preferably includes the barrel 10, the riser 12, the latch housing 14, the first limb 16, the second limb 18, the first cam 20 and the second cam 22. The reverse style crossbow 2 includes all the features of the reverse style crossbow 1 with the exception of first and second cables 38, 54. The first and second cables 38, 54 are replaced with a single cable 76. With reference to FIG. 2, the single cable 76 includes a first end 78 and a second end 80. With reference to FIG. 6, the first end 78 of the single cable 76 is retained on the first cable post 46 and the single cable 76 is retained in the first cable track 44. The second end 80 of the single cable 76 is retained on the second cable post 62 and the single cable 76 is retained in the second cable track 60.

Figure 8:
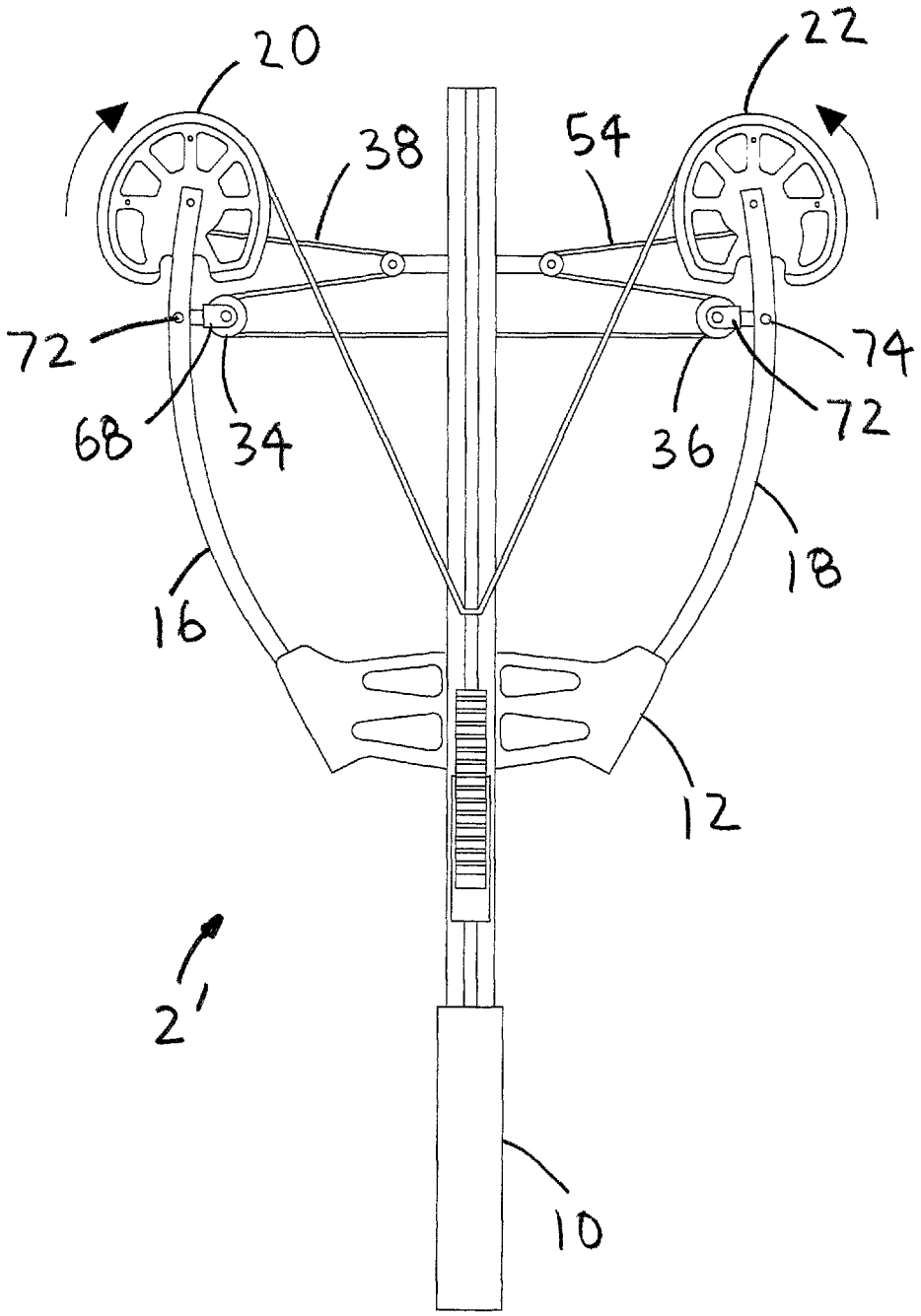
FIG. 8 is a top view of a reverse style crossbow having four pulleys, a single string and a single cable in a partially drawn position, two of the pulleys are rotatably retained inward from the first and second limbs with first and second pulley yokes in accordance with the present invention.

With reference to FIG. 8, a reverse style crossbow having four pulleys 2' includes the first pulley yoke 68 and the second pulley yoke 72. The one end of the first pulley yoke 68 is pivotally engaged with the first limb 16 utilizing the pin 70 or the like and the other end of the first pulley yoke 68 rotatably retains the first limb pulley 34. One end of the second pulley yoke 72 is pivotally engaged with the second limb 18 utilizing the pin 74 or the like and the other end of the second pulley yoke 72 rotatably retains the second limb pulley 36.

In operation, as the bowstring 24 is pulled toward a cocked position, the bowstring 24 unwraps from the first and second cams 20, 22, and the cables 38, 54 or 76 wrap around the first and second cams 20, 22, which causes the first and second limbs 16, 18 to move toward each other and to store energy.

As the bowstring 24 is drawn, there is a cause and effect of pulling on the bowstring 24. As the bowstring 24 is pulled, the first and second cams 20, 22 (string guides) are rotated. As the cams 20, 22 rotate, the bow string 24 unwraps from a perimeter of the cams 20, 22, and the cable 38, 54, 76 wraps the cable tracks 44, 60, which in turn causes the movement of distal end of the limbs 16, 18 to more toward a center line of the barrel 10.

In a conventional bow with a conventional string, cam and cable configuration, there is a direct correlation between movement, wherein the LTT (Limb Tip Travel) distance is directly proportional to the perimeter of the cable cam track. Everything else being equal, the larger the perimeter distance, the greater the LTT. The lesser the perimeter distance of the cable cam track, the lesser the LTT. Further, everything else being equal, the greater the perimeter distance of the string guide track, the longer the power stroke can be, and visa versa. Some prior art crossbows have attempted to limit LTT by creating what is known as a binary style cam system, wherein a payout or unwrapping of the cable is built into the cam. Though this does lessen LTT, rotation of the cam is severely limited, and the binary type cam will lock up, if rotated past 180 to 200 degrees. In order to achieve a long power stroke in a binary style cam, one needs a greater axle to axle distance and a larger diameter string guide track.

LTT: Limb Tip Travel
LIAR: Limb Tips At Rest
LTCP: Limb Tips Cocked Position
PSD: Power Stroke Distance
A=Perimeter length of the string track
B=Perimeter length of the cable track
C=Distance between longitudinal Center Line of barrel and Center line of pulley 34, 36.
D=Distance between centerline of pulley 34, 36 and Centerline of pulley 26, 30.
E=Distance between centerline of 26, 30 and the contact point of the cable with the cable track when the bow is at rest.

As the limbs 16, 18 move towards each other, so do the pulleys 34, 36 that are coupled to the limbs 16, 18. As the pulleys 34, 36 get closer to a centerline of the barrel 10, the pulleys 34, 36 also get closer to the pulleys 26, 30, which in turn causes the cable segment length of C to decrease, and the cable segment length D to decrease, which in turn creates a longer cable segment length of E, which will be referred to as cable payout. The cable payout allows the string guides of the cams 20, 22 to rotate as before, while decreasing LTT.

A decrease in LTT has many benefits. The benefits include less shock due to less distance the limbs 16, 18 move when the crossbow 1 is shot; a greater amount of preload put on the limbs 16, 18, which may increase initial stored energy, and will result in faster cam rotation due to less distance of the LTT.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A crossbow having four pulleys, comprising:
a barrel;
a riser retained on said barrel;
a first limb extends from a first end of said riser;
a second limb extends from a second end of said riser;
a first cam rotatably retained on said first limb;
a second cam rotatably retained on said second limb;
a first barrel pulley rotatably retained on said barrel or adjacent to said barrel;
a second barrel pulley rotatably retained on said barrel or adjacent to said barrel, a distance between said first and second barrel pulleys is fixed relative to each other;
a first limb pulley rotatably retained on said first limb;
a second limb pulley rotatably retained on said second limb;
a first cable having one end secured to said first cam, said first cable contacts said first barrel pulley and said first limb pulley, an opposing end of said first cable is secured to said barrel; and
a second cable having one end secured to said second cam, said second cable contacts said second barrel pulley and said second limb pulley, an opposing end of said second cable is secured to said barrel.

2. The crossbow having four pulleys of claim 1, further comprising:
a bowstring having a first end retained on said first cam and a second end retained on said second cam.

3. The crossbow having four pulleys of claim 2, further comprising:
a latch housing is secured to said barrel, said latch housing retains said bowstring in a fully drawn position.

4. The crossbow having four pulleys of claim 1 wherein:
said first cam includes a first cable track, said first cable makes contact with said first cable track, said second cam includes a second cable track, said second cable makes contact with said second cable track.

5. The crossbow having four pulleys of claim 1, further comprising:
a first pulley bracket rotatably retains said first barrel pulley, a second pulley bracket rotatably retains said second barrel pulley.

6. A crossbow having four pulleys, comprising:
a barrel;
a riser retained on said barrel;
a first limb having a first proximal end and a first distal end, said first proximal end is attached to a first end of said riser;
a second limb having a second proximal end and a second distal end, said second proximal end is attached to a second end of said riser;
a first cam rotatably retained on said first distal end of said first limb;
a second cam rotatably retained on said second distal end of said second limb;
a first barrel pulley rotatably retained on said barrel or adjacent to said barrel;
a second barrel pulley rotatably retained on said barrel or adjacent to said barrel;
a first limb pulley rotatably retained on said first limb;
a second limb pulley rotatably retained on said second limb; and
a cable having a first end secured to said first cam, said cable contacts said first and second barrel pulleys, said cable contacts said first and second limb pulleys, a second end of said cable secured to said second cam.

7. The crossbow having four pulleys of claim 6, further comprising:
a bowstring having a first end retained on said first cam and a second end retained on said second cam.

8. The crossbow having four pulleys of claim 7, further comprising:
a latch housing is secured to said barrel, said latch housing retains said bowstring in a fully drawn position.

9. The crossbow having four pulleys of claim 6 wherein:
said first cam includes a first cable track, said cable makes contact with said first cable track, said second cam includes a second cable track, said cable makes contact with said second cable track.

10. The crossbow having four pulleys of claim 6, further comprising:
a first pulley bracket rotatably retains said first barrel pulley, a second pulley bracket rotatably retains said second barrel pulley.

11. A crossbow having four pulleys, comprising:
a barrel;
a riser retained on said barrel;
a first limb having a first proximal end and a first distal end, said first proximal end is attached to a first end of said riser;
a second limb having a second proximal end and a second distal end, said second proximal end is attached to a second end of said riser;
a first cam rotatably retained on said first distal end of said first limb;
a second cam rotatably retained on said second distal end of said second limb;
a first barrel pulley rotatably retained on said barrel or adjacent to said barrel;
a second barrel pulley rotatably retained on said barrel or adjacent to said barrel;
a first limb pulley rotatably retained on said first limb;
a second limb pulley rotatably retained on said second limb; and
a cable having a first end secured to said first cam, said cable contacts said first and second barrel pulleys, said cable contacts said first and second limb pulleys, a second end of said cable secured to said second cam.

12. The crossbow having four pulleys of claim 11, further comprising:
a bowstring having a first end retained on said first cam and a second end retained on said second cam.

13. The crossbow having four pulleys of claim 12, further comprising:
a latch housing is secured to said barrel, said latch housing retains said bowstring in a fully drawn position.

14. The crossbow having four pulleys of claim 11 wherein:
said first cam includes a first cable track, said cable makes contact with said first cable track, said second cam includes a second cable track, said cable makes contact with said second cable track.

15. The crossbow having four pulleys of claim 11, further comprising:
a first pulley bracket rotatably retains said first barrel pulley, a second pulley bracket rotatably retains said second barrel pulley.

16. A crossbow having four pulleys, comprising:
a barrel;
a riser retained on said barrel;
a first limb having a first proximal end and a first distal end, said first proximal end is attached to a first end of said riser;

a second limb having a second proximal end and a second distal end, said second proximal end is attached to a second end of said riser;

a first cam rotatably retained on said first distal end of said first limb;

a second cam rotatably retained on said second distal end of said second limb;

a first barrel pulley rotatably retained on said barrel or adjacent to said barrel;

a second barrel pulley rotatably retained on said barrel or adjacent to said barrel;

a first limb pulley rotatably retained on said first limb;

a second limb pulley rotatably retained on said second limb; and a first cable having one end secured to said first cam, said first cable contacts said first barrel pulley and said first limb pulley, an opposing end of said first cable is secured to said barrel; and a second cable having one end secured to said second cam, said second cable contacts said second barrel pulley and said second limb pulley, an opposing end of said second cable is secured to said barrel.

17. A crossbow having four pulleys, comprising:

a barrel;

a riser retained on said barrel;

a first limb extends from a first end of said riser;

a second limb extends from a second end of said riser;

a first cam rotatably retained on said first limb;

a second cam rotatably retained on said second limb;

a first barrel pulley rotatably retained on said barrel or adjacent to said barrel;

a second barrel pulley rotatably retained on said barrel or adjacent to said barrel;

a first limb pulley is rotatably retained in a first pulley yoke, said first pulley yoke is pivotally retained in said first limb, an axis of rotation of said first limb pulley is parallel to an axis of rotation of said first barrel pulley;

a second limb pulley is rotatably retained in a second pulley yoke, said second pulley yoke is pivotally retained in said second limb, an axis of rotation of said second limb pulley is parallel to an axis of rotation of said second barrel pulley;

a first cable having one end secured to said first cam, said first cable contacts said first barrel pulley and said first limb pulley, an opposing end of said first cable is secured to said barrel; and a second cable having one end secured to said second cam, said second cable contacts said second barrel pulley and said second limb pulley, an opposing end of said second cable is secured to said barrel.

18. A crossbow having four pulleys, comprising:

a barrel;

a riser retained on said barrel;

a first limb extends from a first end of said riser;

a second limb extends from a second end of said riser;

a first cam rotatably retained on said first limb;

a second cam rotatably retained on said second limb;

a first barrel pulley rotatably retained on said barrel or adjacent to said barrel;

a second barrel pulley rotatably retained on said barrel or adjacent to said barrel;

a first limb pulley is rotatably retained in a first pulley yoke, said first pulley yoke is pivotally retained in said first limb, an axis of rotation of said first limb pulley is parallel to an axis of rotation of said first barrel pulley;

a second limb pulley is rotatably retained in a second pulley yoke, said second pulley yoke is pivotally retained in said second limb, an axis of rotation of said second limb pulley is parallel to an axis of rotation of said second barrel pulley; and a cable having a first end secured to said first cam, said cable contacts said first and second barrel pulleys, said cable contacts said first and second limb pulleys, a second end of said cable secured to said second cam.

* * * * *